US007161141B2

(12) United States Patent
Mimura et al.

(10) Patent No.: US 7,161,141 B2
(45) Date of Patent: Jan. 9, 2007

(54) ION TRAP/TIME-OF-FLIGHT MASS SPECTROMETER AND METHOD OF MEASURING ION ACCURATE MASS

(75) Inventors: Tadao Mimura, Hitachinaka (JP); Yoshiaki Kato, Mito (JP); Toyoharu Okumoto, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 48 days.

(21) Appl. No.: 11/128,261

(22) Filed: May 13, 2005

(65) Prior Publication Data

US 2005/0253060 A1 Nov. 17, 2005

(30) Foreign Application Priority Data

May 14, 2004 (JP) ..... 2004-144286

(51) Int. Cl.

| | |
|---|---|
| ***B01D 59/44*** | (2006.01) |
| ***H01J 49/00*** | (2006.01) |
| ***G01D 18/00*** | (2006.01) |
| ***G12B 13/00*** | (2006.01) |

(52) U.S. Cl. ..... 250/281; 250/282; 250/287; 250/252.1; 250/292

(58) Field of Classification Search ..... 250/252.1, 250/281, 282, 287, 292

See application file for complete search history.

(56) References Cited

U.S. PATENT DOCUMENTS 5,397,894 A * 3/1995 Wells et al. ..... 250/282

2004/0222369 A1* 11/2004 Makarov et al. ..... 250/281

FOREIGN PATENT DOCUMENTS

| | | |
|---|---|---|
| JP | 11-154486 | 6/1999 |
| JP | 2001-28252 | 1/2001 |
| JP | 2001-74697 | 3/2001 |
| JP | 2003-123685 | 4/2003 |

OTHER PUBLICATIONS

"Exact Mass Measurement of Product Ions for the Structural Elucidation of Drug Metabolites with a Tandem Quadrupole Orthogonal-Acceleration Time-of-Flight Mass Spectrometer" by Hopfgartner, et al. 1999 American Society for Mass Spectrometry. pp. 1305-1314.

* cited by examiner

*Primary Examiner*—Jack Berman
*Assistant Examiner*—Jennifer Yantorno
(74) *Attorney, Agent, or Firm*—Mattingly, Stanger, Malur & Brundidge, P.C.

(57) ABSTRACT

An ion trap/time-of-flight mass spectrometer, which can perform accurate mass measurement of a product ion based on MS/MS and MS″ has an ion source for ionizing a sample, an ion trap capable of temporarily trapping ions, and a time-of-flight mass spectrometer. The ion source produces ions of the sample as a measurement target and ions of a reference sample each having a known mass value. A precursor ion is selected from among the ions of the measurement target sample, and the selected precursor ion is excited and fragmented in the ion trap to produce a product ion. The reference sample ions are introduced to and trapped in the ion trap. The trapped product ion and reference sample ions are expelled out of the ion trap and introduced to the time-of-flight mass spectrometer, thereby obtaining a mass spectrum.

7 Claims, 6 Drawing Sheets

ION TRAP/TIME-OF-FLIGHT MASS SPECTROMETER AND METHOD OF MEASURING ION ACCURATE MASS

BACKGROUND OF THE INVENTION

1. Field of the Invention

The present invention relates to an ion trap/time-of-flight mass spectrometer in a combination of an ion trap mass spectrometer and a time-of-flight mass spectrometer.

2. Description of the Related Art

Accurate mass measurement is a method for measuring an ion mass at accuracy of $1/10^6$, i.e., a ppm level, by a mass spectrometer and determining an ion's elemental composition based on the measured accurate ion mass. A structure elucidation of a sample molecule is performed from the determined ion's elemental composition. For an unknown component, because a molecular formula can be directly determined, the accurate mass measurement is very effective in making accurate identification and elucidation of the molecular structure. Examples of a mass spectrometer capable of performing the accurate mass measurement are a double-focusing magnetic sector type mass spectrometer and a time-of-flight mass spectrometer called a TOF.

Particularly, the TOF has been developed as, e.g., Q-TOF including two Quadrupole Mass Spectrometers (QMS's) disposed between an ion source and the TOF, and ion trap-TOF in which the TOF is coupled to an ion trap comprising a ring electrode and a pair of end cap electrodes. Those TOF's are able to perform the accurate mass measurement with a usual process for mass spectrum measurement.

One example of Q-TOF is disclosed in JP,A 11-154486 (Patent Reference 1), and one example of ion trap-TOF is disclosed in JP,A 2003-123685 (Patent Reference 2).

In the accurate mass measurement using the TOF, calibration of a measured value obtained by the mass spectrometer (i.e., mass calibration) is required for an improvement of accuracy.

When a slightly-charged ion having a mass M is accelerated under application of an acceleration voltage U, the ion flies in a vacuum at a speed v. The speed v is determined as follows:

$$v=1.39\times10^4\sqrt{(U/M)} \quad (1)$$

Assuming now that the time required for the ion to fly through a flight space in the TOF with a length L (meter) is t (seconds), the time t is determined by the following formula (2);

$$t=L/v=L/(1.39\times10^4\sqrt{(U/M)}=k\sqrt{(M)} \quad (2)$$

where k is a constant specific to the mass spectrometer. Thus, the ion flight time t is in proportion to the root of the mass. In the actual TOF, the relationship between the ion flight time, i.e., the ion detection time t, and the ion mass M is approximated as follows;

$$M=at^2+bt+c \quad (3)$$

where a, b and c are constants. In other words, a second-order relation formula holds between the mass M and the detection time t of the ion. A process for determining the relation formula (3) is the mass calibration.

In the mass calibration, a reference material providing a plurality of ions having known masses is introduced to the TOF for measurement of a mass spectrum. The constants a, b and c in the relation formula (3) can be determined using the detection time t of each of the appeared ions and the known mass value M. Therefore, the reference material capable of providing the ions having the known masses over a wide mass range is used.

After completion of the mass calibration, by measuring an actual sample, a mass MO of a sample ion can be determined from a detection time t0 of the sample ion based on the formula (3). Such a method of performing the mass calibration using the reference material and the measurement of the actual sample independently of each other after the lapse of time required for the mass calibration as a preceding stage is called an external reference method. One example of the external reference method is disclosed in, e.g., JP,A 2001-74697 (Patent Reference 3).

However, the accuracy of mass measurement performed by the external reference method is generally about 100 to 30 ppm (ppm=$10^{-6}$) at a maximum. This low accuracy is attributable to, e.g., extension and contraction of the TOF flight space L caused by temperature changes around the mass spectrometer, etc. and drifts of the acceleration voltage U, the voltage applied to an electrostatic lens, etc. At a level of such accuracy, the element composition cannot be uniquely determined from the measured accurate mass M.

To determine the element composition with a maximally restricted possibility, the measurement accuracy at a level of 5 ppm or less is required. Ensuring such a level of accuracy requires a sample ion and reference material ions to be introduced to a TOF and measured at the same time. Each of the ions obtained from the reference material has a known mass, and it is referred to as a "lock mass ion". Such a method is generally called an internal reference method. The internal reference method makes it possible to compensate for a temperature drift, etc. and to perform the measurement with high accuracy at all times. Further, because the internal reference material introduced to an ion source of the TOF together with a sample is not required to provide ions over a wide mass range, selection of the reference material is facilitated. One example of the internal reference method is disclosed in, e.g., JP,A 2001-28252 (Patent Reference 4).

Thus, the internal reference method is a method essential for improving the measurement accuracy. In a TOF having the function of MS/MS measurement, such as Q-TOF including a Quadrupole Mass Spectrometers (QMS) upstream of the TOF, however, the mass calibration based on the internal reference method cannot be employed to measure the accurate mass of a product ion obtained by the MS/MS measurement. The reason is that, when a precursor ion is isolated by the first QMS, the lock mass ion of the reference material introduced together with the sample is discarded by the first QMS and is not introduced to the TOF at the same time as the product ion. In other words, because the lock mass ion is lacked in the mass spectrum of the product ion, it is impossible to perform the accurate measurement using the internal reference method.

Journal of American Society for Mass Spectrometry, 10(1999), 1305–1314 (Non-Patent Reference 1) discloses one example trying to cope with such a problem in a manner described below with attention focused on a precursor ion in the MS/MS measurement.

In advance, the accurate mass measurement of an unknown sample is performed by the ordinary method (i.e., the measurement not including the MS/MS measurement) to determine the accurate mass of an ion to be selected as a precursor ion. Then, the MS/MS measurement is performed on the selected precursor ion (through the steps of ion isolation, CID (Collision-Induced Dissociation), and measurement of product ion), and the mass calibration of the product ion is performed while the precursor ion slightly remaining on a mass spectrum of the product ion is used a lock mass ion.

SUMMARY OF THE INVENTION

With the method disclosed in Non-Patent Reference 1. however, the accurate mass measurement of the unknown sample must be performed in the ordinary MS mode in advance. Thereafter, various parameters for the Q-TOF are changed for shift to the MS/MS mode, followed by performing the MS/MS measurement. Stated another way, the ordinary accurate mass measurement and the MS/MS measurement must be separately performed twice at an interval between them. Because that method is one kind of external reference method, an error is doubled and a difficulty is resulted in measurement with high accuracy. It is also difficult to apply the method of Non-Patent Reference 1 to the case, such as an LC/MS analysis, where a plurality of unknown components are successively introduced to a mass spectrometer in a short time.

Thus, although the Q-TOF is able to perform the MS/MS measurement, the method of performing the accurate mass measurement of the product ion based on the MS/MS measurement is not reported other than the method disclosed in Non-Patent Reference 1. Also, the Q-TOF is able to perform the MS/MS measurement, but it cannot perform $MS^n$ measurement that provides higher-order structure information. As a matter of course, it is impossible to perform the accurate mass measurement in an $MS^n$ process.

With the view of solving the problems mentioned above, it is a main object of the present invention to provide an ion trap/time-of-flight mass spectrometer, which can perform accurate mass measurement of a product ion in MS/MS and $MS^n$ processes and can improve accuracy of the measurement.

To achieve the above object, the present invention provides an ion trap/time-of-flight mass spectrometer comprising an ion source for ionizing a sample, an ion trap capable of temporarily trapping ions, and a time-of-flight mass spectrometer. The ion source produces ions of the sample as a measurement target and ions of a reference sample each having a known mass value. A precursor ion is selected from among the ions of the measurement target sample, and the selected precursor ion is excited and fragmented in the ion trap to produce a product ion. The reference sample ions are introduced to and trapped in the ion trap. The trapped product ion and reference sample ions are expelled out of the ion trap and introduced to the time-of-flight mass spectrometer, thereby obtaining a mass spectrum. Thus, the product ion and the reference sample ions are detected at the same time. Further, an accurate mass of the product ion is corrected based on the measured reference sample ions.

According to the present invention, the accurate mass measurement of an $MS^n$ product ion can be realized with the internal reference method. In addition, even when a plurality of unknown samples are successively introduced to a mass spectrometer in a short time such as in an LC/MS analysis, the accurate mass measurement of $MS^n$ product ions can be performed with the internal reference method.

DESCRIPTION OF THE PREFERRED EMBODIMENTS (First Embodiment)

Figure 1:
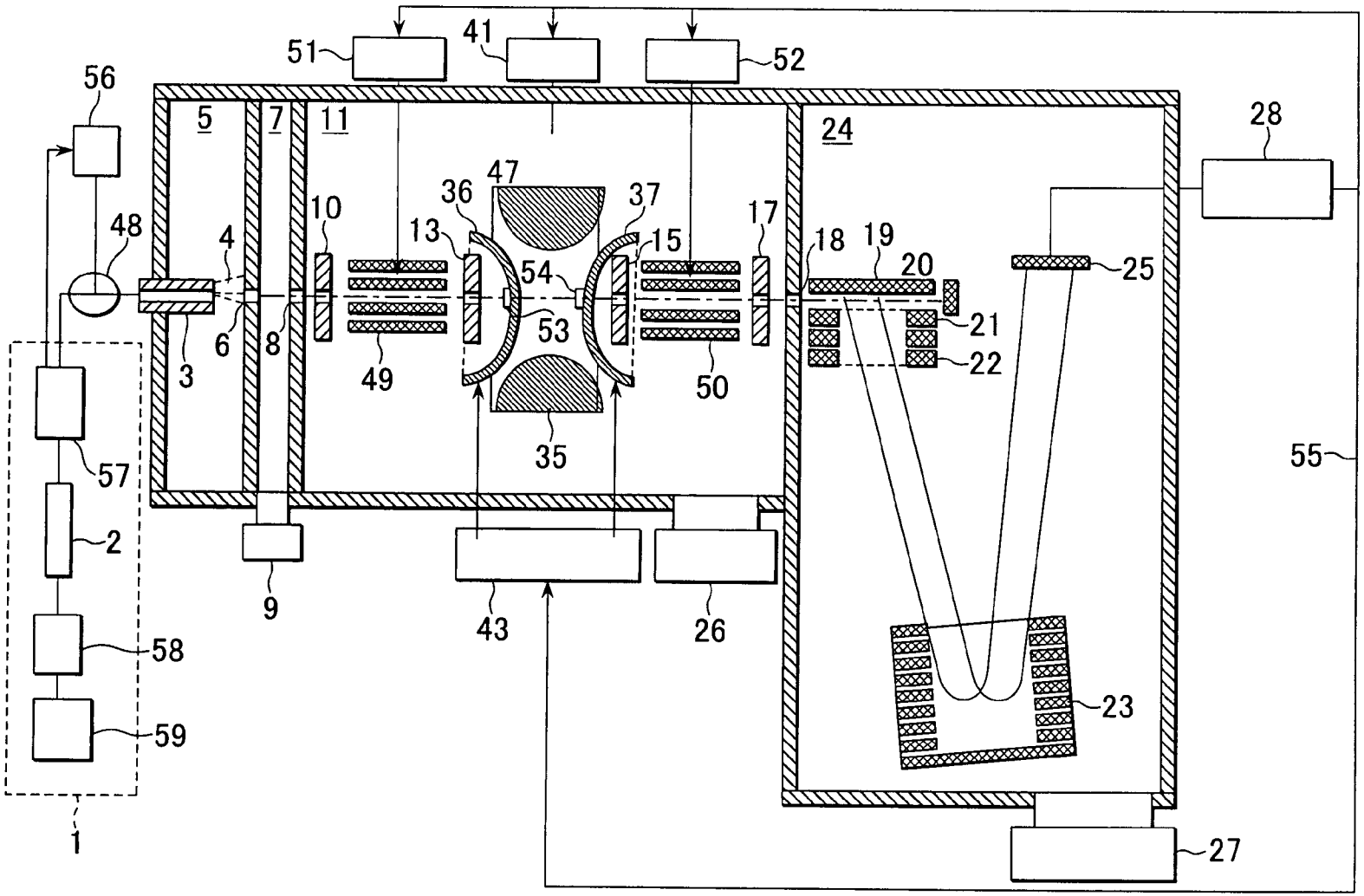
FIG. 1 is a schematic view of a first embodiment of the present invention.

FIG. 1 shows the construction of a mass spectrometer according to a first embodiment.

In a liquid chromatograph (LC) 1, a sample injected from an injector 58 is sent to a column 2 together with an eluent fed by a feed pump 59, and is separated per component. The separated sample components are introduced to a UV detector 57, which detects a UV absorption occurred per sample component, thereby obtaining a UV chromatogram. The sample having passed the UV detector 57 is introduced to an atmospheric ionization chamber 5 (the following description is made, by way of example, in connection with the case using, as an ion source for ionizing the sample, an ESI (Electrospray Ionization) ion source). Each sample component is ionized in the ESI ion source 3, and a produced sample ion is accelerated by an ion acceleration electrode 10 after pasting a first slit electrode 6, an intermediate pressure section 7, and a second slit electrode 8. The accelerated sample ion passes a multi-electrode ion guide 49, an ion gate electrode 13, and a slit 53 in an end cap electrode 36 of an ion trap 47, and is trapped in a space within the ion trap 47. The sample ion trapped in the ion trap 47 is expelled in a kicking-out way to advance toward a TOF (Time-Of-Flight mass spectrometer) 24 upon application of a high DC voltage to the ion trap 47. The sample ion expelled out of the ion trap 47 passes an ion stop electrode 15 and a multi-electrode ion guide 50, following which it is focused by an ion focusing electrode 17 and introduced to the TOF 24 through a slit 18. The sample ion introduced to the TOF 24 is extracted in a direction perpendicular to the direction of introduction of the sample ion by an ion repeller electrode 19 and an ion extraction electrode 21, and is accelerated by an ion acceleration electrode 22. The accelerated sample ion flies toward an ion reflector 23. The ion reflector 23 reverses the flying direction of the ion such that the ion flies toward a detector 25. The detector 25 detects the sample ion to obtain a mass spectrum.

One feature of the present invention resides in the provision of an internal reference sample introducing pump 56 for introducing an internal reference sample. A three-way joint 48 is disposed in a path interconnecting the UV detector 57 and the ESI ion source 3, and the internal reference sample introducing pump 56 introduces the internal reference sample through the three-way joint 48 for ionization in the ESI ion source 3.

The internal reference sample introducing pump 56 is not required to continuously introduce the internal reference sample to the ESI ion source 3, and it is operated to introduce the internal reference sample at the same time as when a sample component is detected by the UV detector 57 and the detected sample component is introduced to the ESI ion source 3, or several seconds or several minutes before or after the introduction of the detected sample component. Also, the internal reference sample is preferably introduced only when an objective sample component subjected to the accurate mass measurement in the MS/MS mode is detected by the UV detector 57. The reason is that because of the internal reference sample having a concentration of several hundreds ppb to several ppm, i.e., a higher concentration than the sample component to be measured, if the internal reference sample is continuously introduced to the ESI ion source 3, contamination of the ESI ion source 3 is caused, thus resulting in a reduction of ionization efficiency of the ESI ion source 3, i.e., a sensitivity deterioration.

In this embodiment, polyethylene glycol (hereinafter abbreviated to "PEG") is used as the internal reference sample. When PEG is measured using the ESI ion source 3, an ion peak appears per m/z 44, and the accurate mass value of each ion peak is known. For that reason, PEG can be conveniently used as the internal reference sample in the accurate mass measurement. It is however required to selectively use PEG 600, PEG 800, and PEG 1000 depending on a region (mass number) where an ion peak of the sample to be subjected to the accurate mass measurement appear. For example, ion peaks of PEG 600 appear in a region of m/z 300 to m/z 700, ion peaks of PEG 800 appear in a region of m/z 500 to m/z 1000, and ion peaks of PEG 1000 appear in a region of m/z 700 to m/z 1200. Accordingly, when the ion peak of the sample to be subjected to the accurate mass measurement appears at m/z 1100, PEG 1000 is used as the internal reference sample.

A description is now made of the operation of the mass spectrometer with the construction shown in FIG. 1 when the accurate mass measurement is performed in the $MS^n$ mode.

Figure 2:
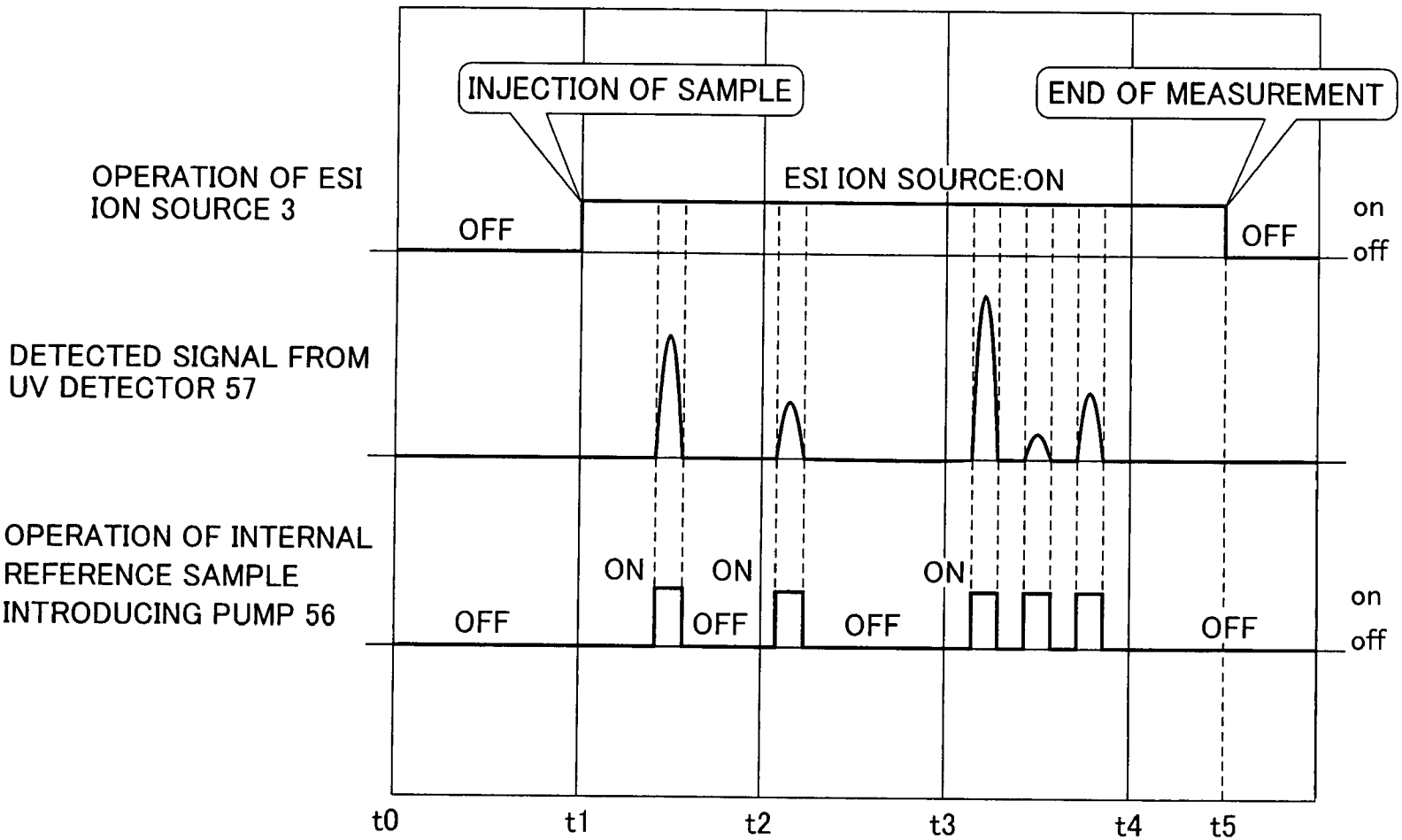
FIG. 2 is a timing chart of processes for injecting a sample and introducing an internal reference sample in the first embodiment.
Figure 3:
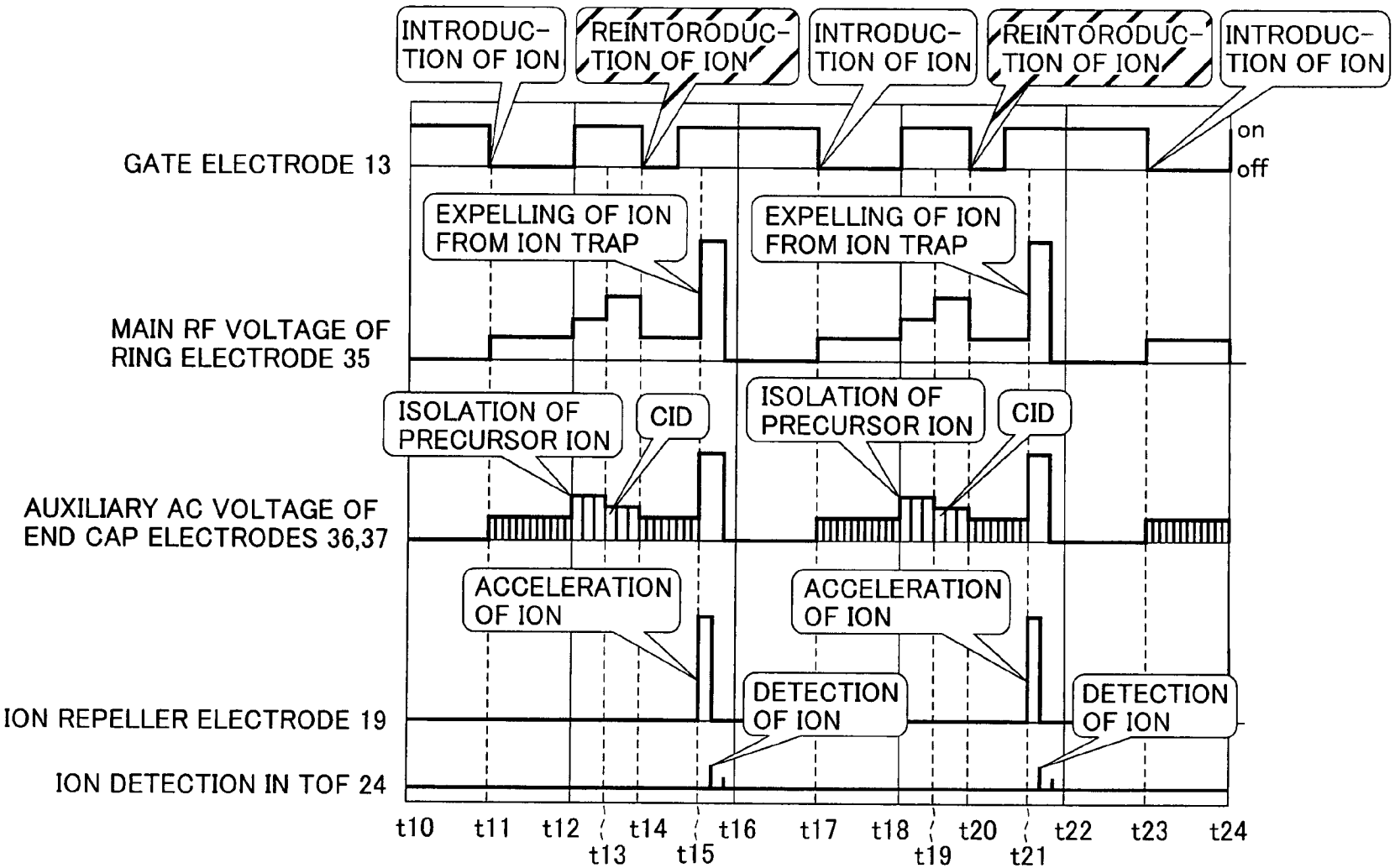
FIG. 3 is a timing chart of a process from ion introduction into an ion trap to ion detection in a TOF in the first embodiment.

FIG. 2 is a timing chart of the operation of the ESI ion source 3, a detected signal from the UV detector 57, and the operation of the internal reference sample introducing pump 56. FIG. 3 is a timing chart for various components of the ion trap 47 and the TOF 24.

In FIG. 2, a time from sample injection t1 to end of measurement t5 is usually about 30 to 90 minutes.

The sample injected from the injector 58 is separated in the column 2 and detected by the UV detector 57. The detected result is given as a UV chromatogram. In the UV chromatogram, the horizontal axis represents time, and the vertical axis represents a concentration of the separated sample component in terms of peak height. The detected signal from the UV detector 57, shown in FIG. 2, corresponds to the UV chromatogram. After passing the UV detector 57, the sample component is introduced to the ESI ion source 3 for ionization. A period of t1 to t5 in FIG. 2 corresponds to the ionization.

In this embodiment, the internal reference sample introducing pump 56 is operated to introduce the internal reference sample only when the separated sample component is detected by the UV detector 57. The internal reference sample introducing pump 56 is operated by a manner of automatically sending, from the UV detector 57, a signal for turning on the internal reference sample introducing pump 56 at the time when the peak height of the UV chromatogram exceeds a setting level, whereby the internal reference sample is introduced to the ESI ion source 3 together with the sample component. At the time when the peak height becomes lower than the setting level, the internal reference sample introducing pump 56 is turned off. In other words, the internal reference sample introducing pump 56 is automatically turned on/off in response to the signal sent from the UV detector 57. As a result, the internal reference sample is introduced to the ESI ion source 3 together with the objective sample component to be measured.

In FIG. 3, when the ion gate electrode 13 is turned on, a gate is closed to shut off introduction of the ion to the ion trap 47, and when the ion gate electrode 13 is turned off, the gate is opened to allow introduction of the ion to the ion trap 47. A time from ion introduction t10 to ion detection t16 in FIG. 3 is about 100 msec to 1000 msec. The operation shown in FIG. 3 is primarily performed at the timing at which the detected signal from the UV detector 57, shown in FIG. 2, is obtained. The operation shown in FIG. 3 will be described in detail below.

1) The sample component ion and the internal reference sample ion both ionized by the ESI ion source 3 are introduced through the first slit electrode 6 and are accumulated (trapped) in the three-dimensional space of the ion trap 47 (t11–t12) after passing the end cap electrode slit 53. The trap time is usually several tens msec to several hundreds msec.
2) Thereafter, an auxiliary AC voltage having a notch formed in a part of the frequency band is applied to the end cap electrodes 36, 37 of the ion trap 47 so that only an $(M+H)^+$ ion, i.e., the sample component ion, is left as a precursor ion within the ion trap 47, while other ions are all purged by resonance absorption (t12–t13). As a result, only the precursor ion remains within the ion trap 47.
3) Subsequently, an auxiliary AC voltage causing only the precursor ion to resonate is applied to the end cap electrodes 36, 37. With the resonance of the precursor ion, energy is applied to the precursor ion upon collision with He gas in the ion trap 47, thereby causing CID (Collision-induced Dissociation) of the precursor ion (t13–t14). As a result, $MS^2$ product ions of the sample component ion are produced in the ion trap 47.
4) Then, the ion gate electrode 13 is turned off to introduce ions from the ESI ion source 3 to the ion trap 47 for a time of several msec to several hundreds msec (t14–t15). Because of the time of t12–t14 in FIG. 3 being about several tens msec, while one component represented by the detected signal from the UV detector 57, shown in FIG. 2, is ionized, it is possible to trap it again. With this reintroduction of the ions, not only the $MS^2$ product ion produced by the CID, but also the sample component ion and the internal reference sample ion both introduced from the ion source are all enclosed in the ion trap 47.
5) Then, at the same time as when cutting off RF voltages applied to the various electrodes of the ion trap 47, high DC voltages are applied such that the $MS^2$ product ion and the internal reference sample ion are expelled in a kicking-out way to be introduced to the TOF 24 (t15) due to the potential difference among the end cap electrode 36, a ring electrode 35, and the end cap electrode 37. The $MS^2$ product ion of the sample component ion and the internal reference sample ion both introduced to the TOF 24 are accelerated toward the ion flying region of the TOF by the ion repeller electrode 19, the ion extraction electrode 21, and the ion acceleration electrode 22, followed by reaching the ion reflector 23. The $MS^2$ product ion of the sample component ion and the internal reference sample ion both having reached the ion reflector 23 are accelerated again toward the detector 25, and the ions are detected by the detector 25 one after another on the order of μsec starting from the ion having the lightest mass (t15–t16).

In this embodiment, since the ions are introduced again from the ESI ion source 3 to the ion trap 47 after producing the sample component ion $(M+H)^+$ as the $MS^2$ product ion, the sample component ion is also enclosed in the ion trap 47 together with the internal reference sample ion. This however just contributes to increasing the intensity of the sample component ion peak detected by the TOF 24 and causes no problems. For an operator of the measurement, the increased intensity of the sample component ion peak in the MS/MS mode is rather advantageous because the sample component ion has a more conspicuous peak.

This embodiment is featured in that the ions are reintroduced to the ion trap 47 during the period of t14–t15 in FIG. 3. This reintroducing operation enables the $MS^2$ product ion and the internal reference sample ion to be accumulated in the ion trap 47 at the same time, and also enables the $MS^2$ product ion and the internal reference sample ion to be expelled out of the ion trap 47 and accelerated toward the TOF 24 at the same time.

A total time from the introduction of the sample ion to the ion trap 47 during the period of t11–t12 in FIG. 3 to the expelling of the ions from the ion trap 47 and the introduction to the TOF 24 at t15 is not longer than 1 second (usually several hundreds msec). On the other hand, the time required for the sample to elute per component from the column 2, shown in FIG. 2, is about 10 to 20 seconds, and therefore the accurate mass measurement of the $MS^n$ product ion can be performed at least 10 to 20 times for one component. Stated another way, this embodiment makes it possible to perform the accurate mass measurement of the $MS^n$ product ion online.

A description is now made of processing after data has been obtained with the operation shown in FIG. 3.

During the period of elution of the sample component from the column 2, the $MS^2$ product ion of the sample component, the internal reference sample ion, and the sample component ion are detected by the TOF 24 at the same time. The detected ions are each converted to an electric signal in the UV detector 25 and taken into a data processing unit 28. The data processing unit 28 displays, as a mass spectrum, the electric signals on a display unit such as a display. In the mass spectrum, the horizontal axis represents a mass (precisely speaking, an m/z value; a ratio of mass to charge), and the vertical axis represents the intensity of the ion.

Figure 4:
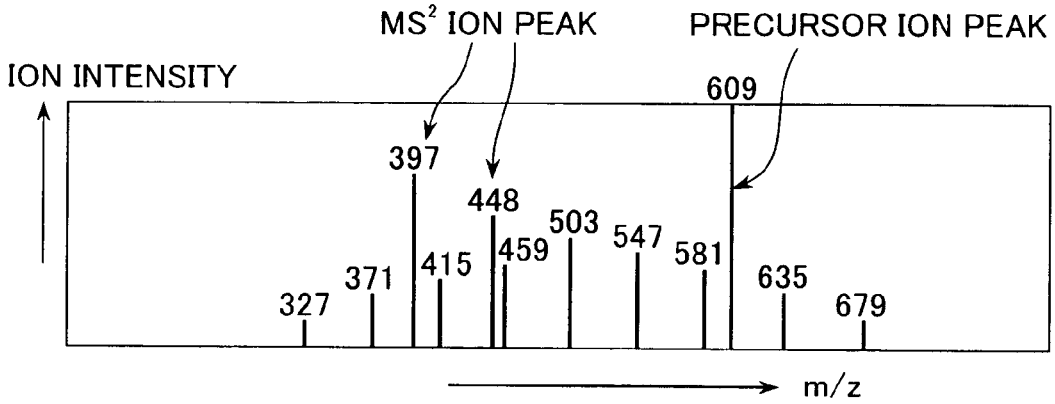
FIG. 4 is a chart showing a mass spectrum obtained in the first embodiment.

FIG. 4 shows, by way of example, results of measurement using, as the sample component, reserpine that is one of crude drugs. PEG 600 is used as the internal reference sample. In FIG. 4, m/z 609 represents a sample component ion peak (although the molecular weight is 608, the ion peak is detected at m/z 609 because the sample component is detected as an $(M+H)^+$ ion), while m/z 448 and m/z 397 represent $MS^2$ product ion peaks of m/z 609. Thus, the mass spectrum obtained in this embodiment indicates the peaks of the $MS^2$ product ions of the sample component, the internal reference sample ion peaks, and the sample component ion peak at the same time.

After displaying the mass spectrum, the operator of the measurement designates the ion peak for which the accurate mass measurement is to be performed.

It is here assumed that the operator designates the ion peak of m/z 397. The ion peak can be designated by moving a cursor to a specified position on a screen using a pointing device, such as a mouse, attached to the data processing unit 28, or by displaying a separate window for entry of characters and inputting a numerical value of m/z to be designated.

Figure 5:
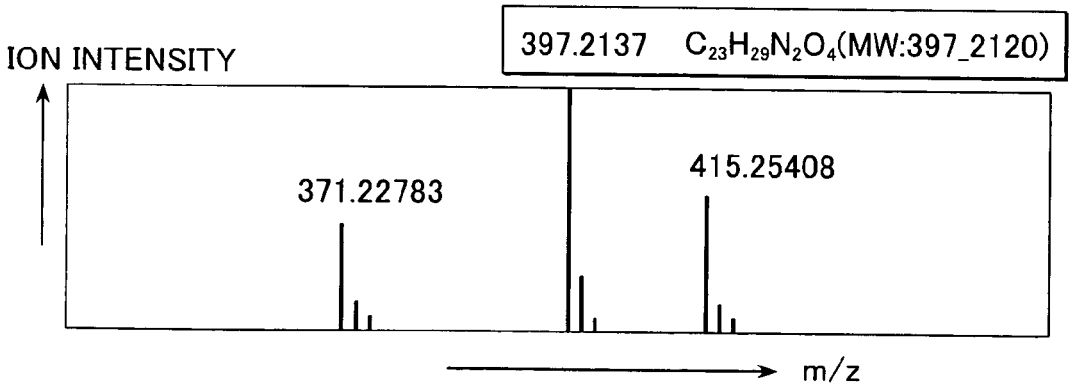
FIG. 5 is a chart showing the result of accurate mass measurement of an $MS^n$ ion peak in the first embodiment.

A chart of FIG. 5 is displayed upon the designation of the ion peak for which the accurate mass measurement is to be performed. In FIG. 5, the ion peaks of m/z 371.22783 and m/z 415.25408 represent ion peaks of PEG 600 as the internal reference sample, which are automatically searched with the designation of m/z 397. Those ion peaks correspond to the known mass values and are registered in the data processing unit 28 beforehand (namely, the accurate masses of a plurality of internal reference samples, which are expected to be used in the measurement, are registered in the data processing unit 28 beforehand). Upon the designation of the ion peak for which the accurate mass measurement is to be performed, if the known ion peaks of the internal reference sample are present nearby (one side or both sides), the accurate mass values of those known ion peaks are displayed automatically. Those known ion peaks are used to calculate the accurate mass value of m/z 397.

Instead of automatically searching the known ion peaks near the designated ion peak, the known ion peaks used for calculating the accurate mass value may be designated by manually designating the ion peaks of PEG, i.e., the internal reference sample, detected on both sides of the objective ion peak to be measured by the operator, whereupon the data processing unit 28 may automatically display the accurate mass value of the manually designated ion peak.

Further, when the ion peak to be subjected to the accurate mass measurement and the known ion peaks are displayed as shown in FIG. 5, the sample component ion peak, the $MS^2$ product ion peak, and the internal reference sample ion peaks are preferably displayed in different colors so that the operator can easily discriminate those ion peaks.

With the definition of the ion peaks having the known accurate mass values, the accurate mass value of the objective ion peak to be accurately measured is calculated. In FIG. 5, the accurate mass value of the designated ion peak of m/z 397 is calculated based on the values of the two known ion peaks and is displayed on a screen. Thus, m/z 397.2137 is the result calculated in such a way, i.e., the result of the $MS^2$ product ion peak calculated based on the accurate mass values of the internal reference sample ion peaks.

Further, a molecular formula corresponding to the ion peak is determined from the calculated result and then displayed. In the measurement result of the illustrated example, the molecular formula estimated by the operator is obtained, and the difference between the theoretical mass (397.2120 amu) of that molecular formula and the measured accurate mass value is just 0.0017 amu (1.7 milli-amu). The accurate mass value thus calculated is displayed on the left or right side or above the objective ion peak.

According to this embodiment, as described above, for the ion peak designated by the operator, the accurate mass measurement can be easily performed using the ion peaks that exist on the same mass spectrum and having the known mass values.

(Second Embodiment)

Figure 6:
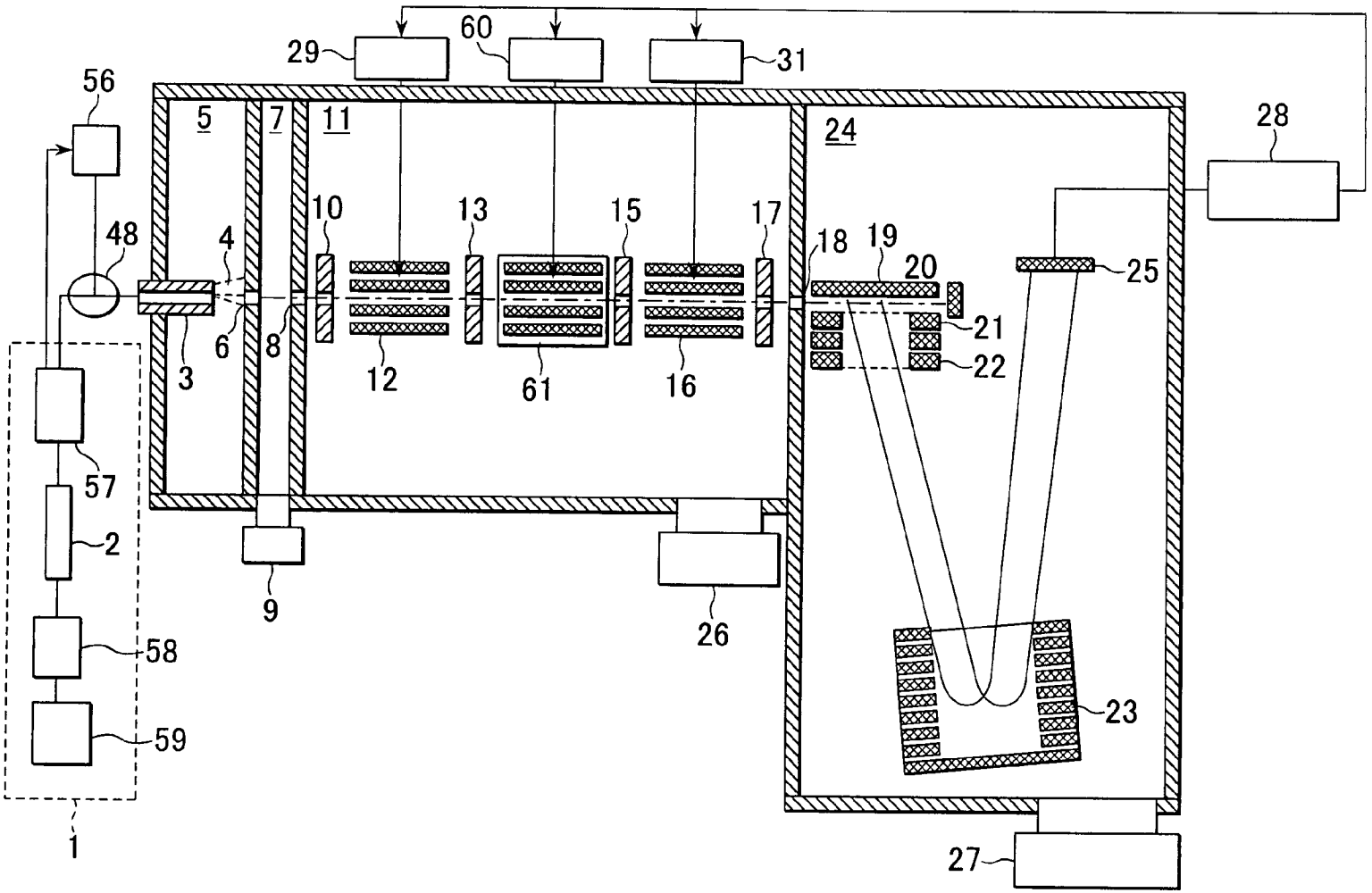
FIG. 6 is a schematic view of a second embodiment of the present invention.

FIG. 6 shows the construction of a mass spectrometer according to a second embodiment.

The construction of the mass spectrometer according to this second embodiment is featured in that the ion trap 47 and a main RF power supply 41 in the first embodiment are replaced with a linear ion trap 61 and a linear ion trap power supply 60, respectively. The other construction is the same as that in the first embodiment. The linear ion trap 61 comprises four columnar (pole-like) electrodes.

The operation for trapping ions is basically the same as that in the first embodiment using the ion trap 47. The main RF voltage applied to the ring electrode 35 of the ion trap 47 is similarly applied to the four electrodes of the linear ion trap 61, and the auxiliary AC voltage applied to the end cap electrodes 36, 37 is superimposed on the main RF voltage and applied to the four electrodes of the linear ion trap 61 together with the main RF voltage. The purposes of the main RF voltage and the auxiliary AC voltage superimposed on the main RF voltage are the same as the purposes of the voltages applied to the ion trap 47. Correspondingly, the linear ion trap power supply 60 is prepared as a power supply satisfying those specifications.

Figure 7:
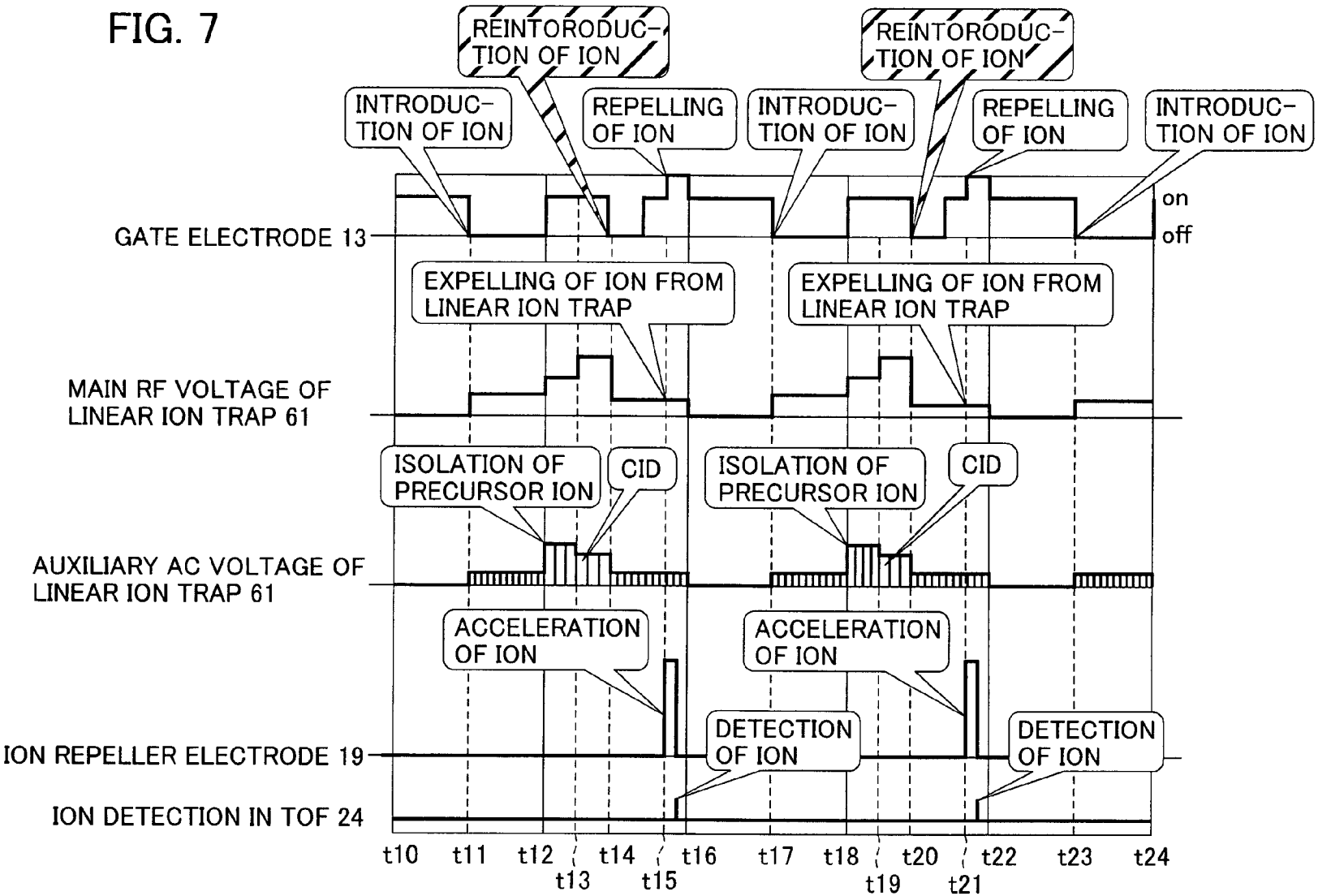
FIG. 7 is a timing chart of a process from ion introduction into an ion trap to ion detection in a TOF in the second embodiment.

A description is now made of the operation from ion introduction to the linear ion trap 61 to ion detection in the TOF 24 (t10–t16) with reference to FIG. 7. Note that, in the process after t16, the operation in t10–t16 is repeated likewise.

1) In the step of ion introduction, the voltage applied to the ion gate electrode 13 is controlled in a similar manner to the case using the ion trap 47 such that ions are introduced to the linear ion trap 61 (t11–t12).
2) To trap the ions, the main RF voltage and the auxiliary AC voltage superimposed on the main RF voltage are applied to the linear ion trap 61 (t11–t12). The reason of applying the auxiliary AC voltage resides in trapping ions within a certain mass range and purging other ions under resonance.
3) Then, for the MS/MS measurement, isolation of a particular ion (i.e., isolation of a precursor ion) is first performed (t12–t13). This step is performed by applying an auxiliary AC voltage having a frequency component, at which only the particular ion is not resonated, for several tens msec, thereby purging the other ions than the particular ion out of the linear ion trap 61. The precursor ion is thereby isolated.
4) Subsequently, the particular ion is dissociated (t13–t14). In this step, an auxiliary AC voltage having a frequency component, at which only the particular ion is resonated, is applied for several tens msec to increase the resonance amplitude of the particular ion so that the particular ion is dissociated through collision with He gas (namely, it is subjected to CID).
5) Thereafter, the voltage applied to the ion gate electrode 13 is controlled so as to introduce an internal reference sample ion having the known accurate mass to the linear ion trap 61 (t14–t15).
6) Finally, the dissociated particular ion and the internal reference sample ion both in the trapped state are expelled in a kicking-out way from the linear ion trap 61 at the same time to be introduced to the TOF 24 (t15). A repeller voltage to repel the ion is applied to the ion gate electrode 13. At this time, the main RF voltage and the auxiliary AC voltage are maintained at the same levels as those applied in the ion trapping step. The expelled particular ion and internal reference sample ion are both repelled by the ion repeller electrode 19 within the TOF 24, and the ions are detected by the detector 25.

A subsequent step of calculating an accurate mass value of the particular ion having been subjected to the MS/MS measurement is performed in the same manner as in the first embodiment.

Thus, in the mass spectrometer using the linear ion trap, the particular ion having been subjected to the MS/MS measurement and the internal reference sample ion can be detected in the TOF at the same time. As a result, the accurate mass measurement can be performed with ease.

What is claimed is:

1. An ion trap/time-of-flight mass spectrometer including a liquid chromatograph having a column for separating a sample, an ion source for ionizing the sample eluted from said liquid chromatograph, an ion trap capable of temporarily trapping ions, a time-of-flight mass spectrometer, and a data processing unit for collecting detection results of said time-of-flight mass spectrometer, said ion trap/time-of-flight mass spectrometer comprising:

means for introducing a reference sample having a known mass value to said ion source in match with elution of the sample from said liquid chromatograph, wherein said data processing unit collects data detected by said time-of-flight mass spectrometer through the steps of causing a precursor ion to be selectively left from among ions of the sample as a measurement target, exciting and fragmenting the precursor ion to produce a product ion, introducing ions of the reference sample to said ion trap, and expelling, out of said ion trap, the product ion and the reference sample ions both trapped in said ion trap, thereby correcting an accurate mass of the product ion based on the measured reference sample ions.

2. The ion trap/time-of-flight mass spectrometer according to claim 1, wherein said ion trap comprises a ring electrode and a pair of end cap electrodes.

3. The ion trap/time-of-flight mass spectrometer according to claim 1, wherein said ion trap comprises multi-pole electrodes.

4. The ion trap/time-of-flight mass spectrometer according to claim 1, wherein said data processing unit includes a display unit and displays, on said display unit, a measured mass spectrum containing peaks of the product ion and the reference sample ions.

5. The ion trap/time-of-flight mass spectrometer according to claim 4, wherein said data processing unit stores accurate mass values of a plurality of reference samples therein beforehand, and searches and displays the reference samples near the mass of an ion designated by an operator of the measurement from among the displayed product ions.

6. The ion trap/time-of-flight mass spectrometer according to claim 4, wherein the peaks of the product ion and the reference sample ions are displayed in different colors.

7. A method of measuring an ion accurate mass by an ion trap/time-of-flight mass spectrometer comprising an ion source for ionizing a sample, an ion trap capable of temporarily trapping ions, and a time-of-flight mass spectrometer, said method comprising the steps of:

producing ions of the sample as a measurement target and ions of a reference sample each having a known mass value by said ion source;

introducing and trapping the ions of the measurement target sample to and in said ion trap;

selecting a precursor ion from among the ions of the measurement target sample to be left in said ion trap, while purging the other ions out of said ion trap;

exciting and fragmenting the precursor ion to produce a product ion;

introducing and trapping the reference sample ions to and in said ion trap;

expelling, out of said ion trap, the product ion and the reference sample ions both trapped in said ion trap, to be introduced to said time-of-flight mass spectrometer; and obtaining a mass spectrum of the introduced ions by said time-of-flight mass spectrometer, thereby correcting an accurate mass of the product ion based on the measured reference sample ions.

* * * * *